US012420904B1

(12) United States Patent
Roop

(10) Patent No.: US 12,420,904 B1
(45) Date of Patent: Sep. 23, 2025

(54) MARINE VESSEL VENTILATION SYSTEM

(71) Applicant: Shorebreak, LLC, Virginia Beach, VA (US)

(72) Inventor: Robert Darron Roop, Virginia Beach, VA (US)

(73) Assignee: Shorebreak, LLC, Virginia Beach, VA (US)

( * ) Notice: Subject to any disclaimer, the term of this patent is extended or adjusted under 35 U.S.C. 154(b) by 0 days.

(21) Appl. No.: 19/078,080

(22) Filed: Mar. 12, 2025

Related U.S. Application Data

(60) Provisional application No. 63/564,315, filed on Mar. 12, 2024.

(51) Int. Cl.
*B63J 2/02* (2006.01)
*B63B 19/00* (2006.01)

(52) U.S. Cl.
CPC ..... *B63J 2/02* (2013.01); *B63B 2019/0046* (2013.01)

(58) Field of Classification Search
CPC ... B63B 17/00; B63B 17/02; B63B 2017/026; B63B 19/00; B63B 2019/046; B63J 2/00; B63J 2/02
USPC ..... 114/211, 343, 361, 364
See application file for complete search history.

(56) References Cited

U.S. PATENT DOCUMENTS

| | | | | |
|---|---|---|---|---|
| 877,655 | A * | 1/1908 | Low | B63J 2/06 114/211 |
| 3,018,784 | A * | 1/1962 | Buxman | B63B 17/02 114/211 |
| 5,709,163 | A * | 1/1998 | Livingston | B63B 19/04 114/211 |
| 6,712,689 | B2 * | 3/2004 | Clarkson | B63J 2/04 114/211 |
| 11,111,002 | B2 * | 9/2021 | Mills | B63J 2/02 |
| 11,648,826 | B2 * | 5/2023 | Dube | B63J 2/04 296/87 |

* cited by examiner

*Primary Examiner* — Daniel V Venne
(74) *Attorney, Agent, or Firm* — Kaufman & Canoles, P.C.

(57) ABSTRACT

Systems and methods of marine vessel ventilation are provided. In one exemplary embodiment, a marine vessel includes a hardtop structure disposed about a helm area that includes a support structure coupled to a center console structure and a windshield structure. Further, the windshield structure is disposed between the helm area and a bow area with a portion of the hardtop structure being disposed in the bow area. The hardtop structure includes a ventilation system having an airflow cavity disposed in the hardtop structure with inlet and outlet apertures associated with the respective bow and helm areas. The airflow cavity is configured to enable airflow from the inlet aperture to the outlet aperture. In addition, the ventilation system further includes an inlet or outlet vent structure configured to control the airflow entering or exiting the inlet or outlet aperture.

20 Claims, 12 Drawing Sheets

7G-7G

MARINE VESSEL VENTILATION SYSTEM

CROSS REFERENCE TO RELATED APPLICATIONS

This application claims the benefit of U.S. Prov. App. No. 63/564,315, filed Mar. 12, 2024, which is hereby incorporated by reference as if fully set forth herein.

FIELD OF DISCLOSURE

The present disclosure relates generally to the field of marine vessels, and in particular to ventilation methods and systems of marine vessels.

BACKGROUND

Marine vessels, such as ships and boats, require effective ventilation systems to maintain comfort, air quality, regulate temperature, and prevent the buildup of hazardous gases within partially enclosed and enclosed spaces. Traditional ventilation systems often face challenges related to moisture intrusion, corrosion, energy efficiency, and maintaining consistent airflow, particularly in marine environments. As vessels become more complex, the need for advanced ventilation solutions that address these challenges while ensuring safety and comfort for passengers and crew has grown significantly. Innovations in ventilation technology can optimize air circulation, reduce maintenance requirements, and improve overall vessel performance, making them essential components of modern marine engineering.

The Background section of this document is provided to place embodiments of the present disclosure in technological and operational context, to assist those of skill in the art in understanding their scope and utility. Unless explicitly identified as such, no statement herein is admitted to be prior art merely by its inclusion in the Background section.

BRIEF DESCRIPTION OF THE DRAWINGS

The present disclosure will now be described more fully hereinafter with reference to the accompanying drawings, in which embodiments of the disclosure are shown. However, this disclosure should not be construed as limited to the embodiments set forth herein. Rather, these embodiments are provided so that this disclosure will be thorough and complete, and will fully convey the scope of the disclosure to those skilled in the art. Like numbers refer to like elements throughout.

Reserved.

Figure 4:
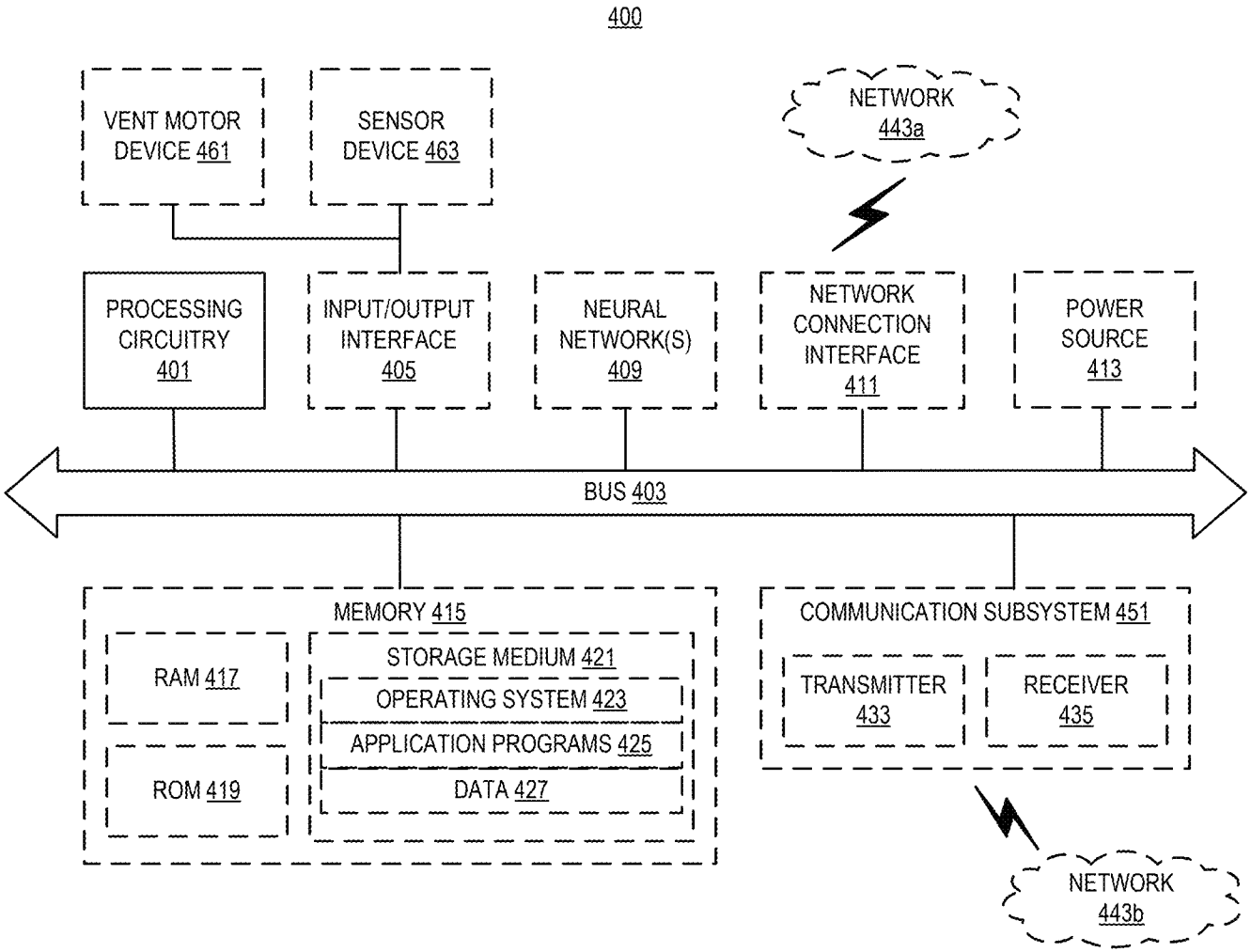

FIG. 4 illustrates one embodiment of a marine vessel ventilation system controller or device in accordance with various aspects as described herein.

DETAILED DESCRIPTION

For simplicity and illustrative purposes, the present disclosure is described by referring mainly to an exemplary embodiment thereof. In the following description, numerous specific details are set forth in order to provide a thorough understanding of the present disclosure. However, it will be readily apparent to one of ordinary skill in the art that the present disclosure may be practiced without limitation to these specific details.

In this disclosure, systems and methods of marine vessel ventilation are provided. The present disclosure describes, among other things, ventilation of the helm area of a marine vessel using a vent channel to funnel ambient air around the vessel's windshield or windscreen to enable a seamless windshield structure with ventilation and without the use of openings in the windshield or windscreen that may obstruct or hinder the line of sight from the helm area. A seamless windshield structure on a marine vessel provides a clear, unobstructed view, enhancing visibility and aesthetics. Further, airflow around a windshield structure of a marine vessel, rather than through a portion that can be opened and closed, is beneficial because it preserves the watertight integrity of the window and eliminates the risk of leaks or water ingress. Additionally, a seamless windshield structure offers a clear, unobstructed view, which is especially important for navigation and aesthetics. In contrast, windows with seams associated with movable window portions can cause visual distortions, reduce structural strength, and increase maintenance needs due to potential seal degradation. The vent channel is disposed between rigid surfaces of the vessel's hardtop housing geometry and tower cap plate. The hardtop structure is positioned above the helm area and is configured to provide weather cover to crew in the helm area. A tower structure is configured to support the hardtop. Further, the tower structure may be configured to support a rigid enclosure (e.g., glass, acrylic, etc.) or a soft enclosure (e.g., eisenglass, strataglas, etc.). A cap plate is configured as the connective plate (or plates) at the upper extent of the tower. A funneling geometry structure may be used to increase or decrease airflow towards the intake vent aperture. Further, dampers may be incorporated to provide greater control over the velocity of air flow from the outlet vent aperture.

FIGS. 1A-1D illustrate embodiments of a marine vessel 100 having a ventilation system 121 in accordance with various aspects as described herein. In FIGS. 1A-1D, the vessel 100 (e.g., cargo vessel, passenger vessel, fishing vessel, recreational vessel, offshore vessel, service vessel, special purpose vessel) can include a deck sole 103 (e.g., floor surface) and a housing structure 105 (e.g., center console, dual console, side console, pilothouse, flybridge, T-top console, hardtop console, walkaround console, cuddy cabin console, deckhouse helm) associated with a helm area 161 and a bow area 163 of the vessel 100. The housing structure 105 can include a hardtop structure 107 (e.g., fiberglass hardtop, aluminum hardtop, enclosed hardtop, convertible hardtop, integrated hardtop, T-top hardtop, tower hardtop, canvas-covered hardtop, solar hardtop), a support structure 109 (e.g., tower structure, T-top structure, arch structure, pipe frame structure, integrated frame structure, cantilevered structure, post and beam structure, modular structure, ladder structure) having support assemblies 109*a-c* configured to support the hardtop structure 107, a console structure 111, an integrated windshield structure 113 having a window 115, the ventilation system 121, or the like. The hardtop structure 107 can include a cap plate structure 117 disposed at the bottom the hardtop structure 107 (e.g., beam cap plate, post cap plate, bulkhead cap plate, deck edge cap plate, hull cap plate, tower or hardtop cap plate, stringer cap plate, keel cap plate, cross member cap plate, railing cap plate). The hardtop structure 107 can be disposed about the helm area 161 with a front portion of the hardtop structure 107 extending about the bow area 163. The support structure 109 can be mechanically coupled to the center console structure 111 having a console 112. The windshield structure 113 such as a seamless windshield structure can be disposed between the helm area 161 and the bow area 163. The seamless windshield structure can be disposed between the bow and helm areas of a marine vessel and can be configured to provide increased visibility, structural strength, and environmental protection while maintaining a watertight and airtight seal. This structure can provide additional safety features such as protecting the helm area from wind, water spray, and debris while ensuring clear sightlines for navigation. The seamless windshield structure design can eliminate the need for openable/closeable window sections, reducing the risk of seal failure and visual obstructions associated with the seals of those window sections. Further, the seamless windshield structure may be slightly curved or angled to enhance aerodynamics, promote water runoff, and reduce glare from sunlight. In addition, a seamless windshield structure may feature built-in heating elements or defogging systems, which are typically integrated within the laminated glass layers. These systems can help prevent fogging or ice buildup without compromising the integrity of the seal. Additionally, the ventilation system 121 can direct airflow around the perimeter of the seamless windshield structure to reduce condensation and maintain clarity.

In FIGS. 1A-1D, the ventilation system 121 can include an airflow cavity 130 (e.g., ventilation duct cavity, bilge airflow cavity, hull airflow cavity, deckhead airflow cavity, coaming airflow cavity, plenum chamber, cowl vent cavity, engine room airflow cavity, cable and pipe chase cavity, stack and funnel cavity, natural convection cavity) disposed in the housing structure 107 with an inlet aperture 129 and an outlet aperture 137*a,b* associated with the respective bow and helm areas 161, 163. An airflow cavity such the airflow cavity 130 can be formed in, about or between the hardtop structure 107, the support structure 109, the support assemblies 109*a-c,* the console structure 111, the cap plate structure 117, the like, or any combination thereof. Each aperture may include a vent grate configured to cover or protect that aperture to allow airflow while inhibiting debris, an object, or an unwanted material from entering the ventilation system 121. A vent grate or filter can include a structure having slats, bars, or a mesh pattern configured to enable airflow while providing structural support or safety. As illustrated in FIGS. 1A-1D, the outlet aperture 137*b* is positioned above the console structure 111 and the outlet aperture 137*a* is positioned above the console 112. The airflow cavity 130 can be configured to enable airflow from the inlet aperture 129 to the outlet aperture 137*a,b*. The ventilation system 121 can further include an inlet vent structure 128 and an outlet vent structure 135. The inlet vent structure 128 can be associated with the inlet aperture 129. The outlet vent structure 135 can be associated with the outlet aperture 137*a,b*. As shown in FIGS. 1A-1D, the outlet vent structure 135 corresponds to the outlet aperture 137*a* but can also be applied to the outlet aperture 137*b*. The inlet vent structure 128 can be configured to selectively control airflow entering the inlet aperture 129. Further, the outlet vent structure 135 can be configured to control airflow exiting the outlet aperture 137*a,b*. Each of the vent structures 128, 135 can be: an air vent configured to control airflow; a directional air vent (e.g., adjustable louver having slats) configured to be manually adjusted to direct airflow in various directions; a fixed air vent (e.g., static louver having immovable slats) configured to guide airflow in one direction; a swivel air vent (e.g., ball-and-socket vent) configured to enable airflow to be directed in multiple directions; an adjustable cone vent (e.g., jet nozzle) having a conical shape configured to be rotated to change airflow direction and volume; a floor vent can be installed at floor level and can be configured to distribute air upwards; a ceiling vent can be mounted on a ceiling and can be configured to distribute air downward; a side vent can be mounted on a wall and can be configured to distribute air; a circular vent (e.g., turbine or rotary vent) configured to be rotated about a central axis to adjust the direction of airflow; a perforated or grille vent having a grid of small holes or slits configured to diffuse air evenly so as to create a gentle or even breeze; a pop-up vent can be configured to be retracted or popped up to enable airflow; a Venturi vent (e.g., scoop vent) configured to increase or decrease airflow speed using the Venturi effect; an exhaust vent configured to expel air from an enclosed space; a motorized vent configured to be electronically controlled to adjust the direction or the airflow based on a sensor or user input; a linear slot vent having a long, narrow opening configured to provide a continuous airflow; a plenum vent configured to distribute air from a central chamber or plenum so as to equalize pressure or maintain consistent airflow; a diffuser vent having a cone or blade arrangement configured to mix air evenly so as to reduce draftiness while increasing air mixing; a pressure relief vent configured to equalize pressure between compartments such as between the helm area 161 and the bow area 163 to maintain structural integrity; the like; or any combination thereof.

Furthermore, the ventilation system 121 can include a ventilation control system configured to process sensor data or command motor actions to selectively control a motorized vent device. The ventilation control system can include a controller device operable to process signals and manage motor operations. The benefits of the ventilation system 121 having a motorized vent can include enhanced comfort through adjustments to the motorized vent to maintain certain airflow or temperature; energy efficiency to reduce heating or cooling demands of an HVAC system installed on the marine vessel 100 by adapting to real-time conditions; automated control via a motor and a sensor that collectively operate for precise ventilation management; reduced maintenance due to automated adjustments of a motorized vent to reduce the wear caused by manual operation of a vent.

Moreover, a motorized vent device can be operable to selectively control airflow direction, volume, or temperature such as based on sensor input, manual control or automatic control. A motorized vent device can include a motorized louver vent having an electric motor operable to drive a linkage mechanism to tilt or rotate the louvers to direct airflow such as horizontally or vertically; a motorized damper vent having a motor operable to open or close a damper blade to enable regulating the airflow through the vent; a pop-up or retractable vent having a linear actuator or a small DC motor operable to conceal the vent when not in use and to extend the vent to enable airflow when activated; a rotary vent having a stepper motor or servo motor operable to rotate the vent to change airflow direction; a jet nozzle vent having a servo or stepper motor operable to pivot the nozzle for targeted airflow; a linear slot vent having a small servo motor operable to adjust the damper position; the like; or any combination thereof. The ventilation system 121 can include one or more sensors such as temperature sensors operable to measure a temperature where the ventilation system 121 can be configured to selectively adjust a vent position or airflow volume based on the measured temperature; a humidity sensor operable to measure a moisture level in the air where the ventilation system 121 can be configured to selectively adjust a vent configuration based on the measured moisture level; a $CO_2$ or air quality sensor operable to measure a $CO_2$ level or an air quality level where the ventilation system 121 can be configured to selectively adjust a vent position or airflow volume based on the $CO_2$ level or the air quality level; a pressure sensor operable to measure a pressure where the ventilation system 121 can be configured to selectively adjust a vent position based on the measured pressure; an airflow sensor 138 operable to measure the speed or volume of the airflow where the ventilation system 121 can be configured to selectively adjust a vent configuration based on the measured airflow; an occupancy or motion sensor operable to detect the presence or movement of an occupant where the ventilation system 121 can be configured to adjust vents to direct airflow towards occupied areas based on the detected presence or movement of an occupant; a light sensor operable to detect light levels where the ventilation system 121 can be configured to adjust airflow or vent position based on sunlight exposure or interior lighting conditions; a manual knob or switch operable to directly control a motor to manually adjust a vent; the like; or any combination thereof.

In FIGS. 1A-1D, each vent structure 128, 135 can include a vent cover 131, 136, a motor device 132 operable to control the vent cover 131 such as via a vent arm 133. The motor device 132 can be securely coupled to the hardtop structure 107 via a support structure 134 in the cavity 130. The motor device 132 can be mechanically coupled to the vent cover 131 via the vent arm 133 and can be operable to position the vent cover 131 in one of a set of vent cover positions relative to the inlet aperture 129. The set of vent cover positions relative to the inlet or outlet aperture 129, 137*a,b* can include a first vent cover position associated with fully obstructed airflow entering or exiting that aperture 129, 137*a,b*, a second vent cover position associated with partially obstructed airflow entering or exiting that aperture 129, 137*a,b*, or a third vent cover position associated with unobstructed airflow entering or exiting that aperture 129, 137*a,b*. In addition, the ventilation system 121 can include a controller device operationally coupled to the motor device 132 and operable to control the motor device 132 to position the vent cover 131 in the one of the set of vent cover positions relative to the inlet aperture 129. As shown in FIGS. 1A-1D, the vent cover 131 is in a vent cover position associated with unobstructed airflow entering the inlet aperture 129.

In another embodiment, the ventilation system 121 can include an inlet vent structure 141*a,b* having an inlet aperture 142*a,b* and a vent cover 143*a,b*. The inlet vent structure 141*a,b* can be configured to control airflow through the inlet aperture 142*a,b* to the outlet apertures 137*a,b* through a side airflow cavity 144*a,b* and the main airflow cavity 130.

In another embodiment, the ventilation system 121 can include an inlet vent structure 141*a,b* having an inlet aperture 142*a,b*, a vent cover 143*a,b*, and a motor device mechanically coupled to the vent cover 143*a,b*. The inlet vent structure 141*a,b* can be configured to control airflow through the inlet aperture 142*a,b* towards the outlet apertures 137*a,b* such as through the side airflow cavity 144*a,b* and the main airflow cavity 130. The motor device can be operable to position the vent cover 143*a,b* in one of a set of vent cover positions relative to the inlet aperture 142*a,b* to control the airflow through the inlet aperture 142*a,b*. The controller device can be operationally coupled to the motor device and can be operable to control the motor device to position the vent cover 143*a,b* in one of the set of vent cover positions relative to the inlet aperture 142*a,b*.

Figure 1A:
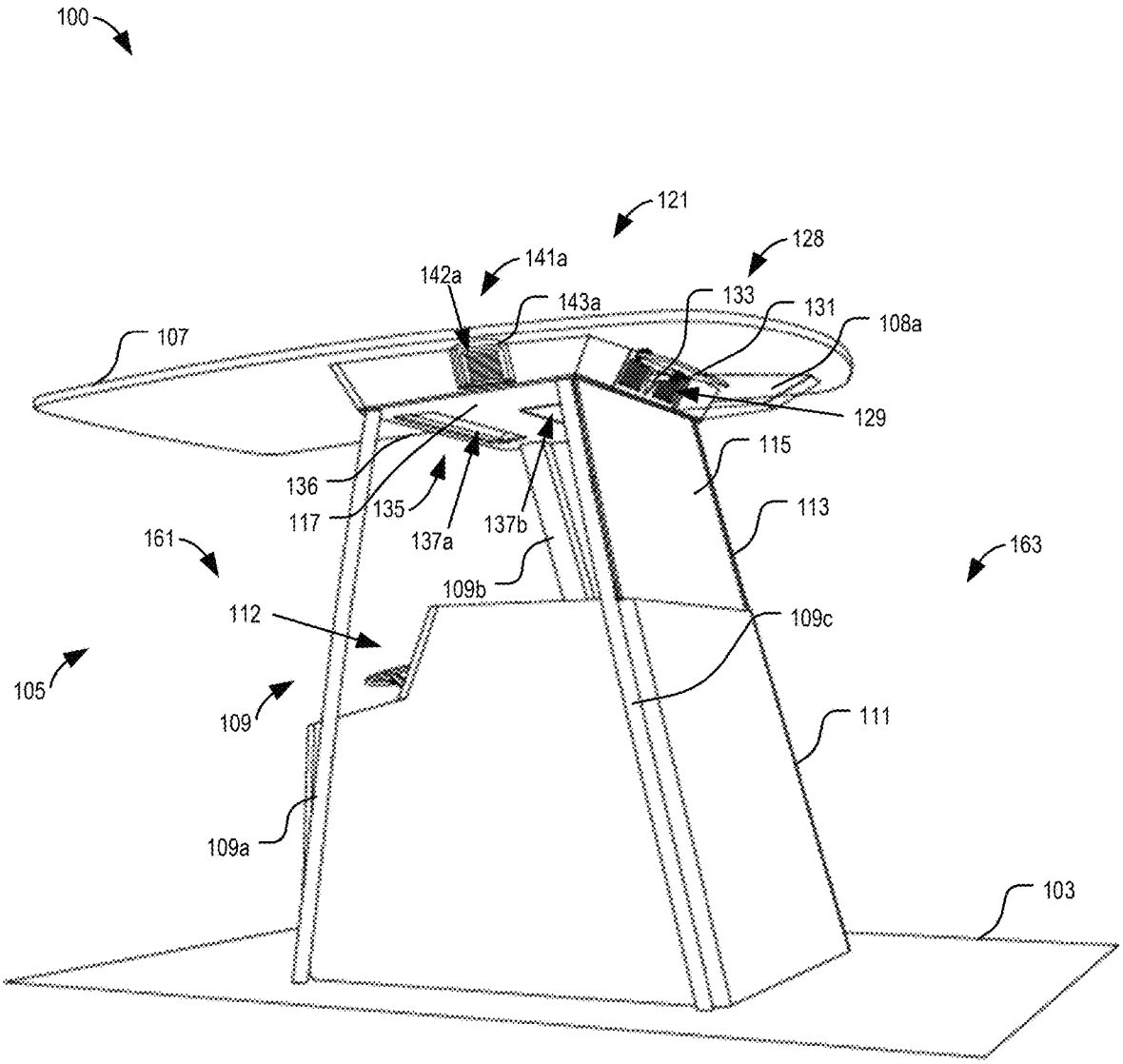
FIGS. 1A-1D illustrate embodiments of a marine vessel having a ventilation system in accordance with various aspects as described herein.
Figure 1B:
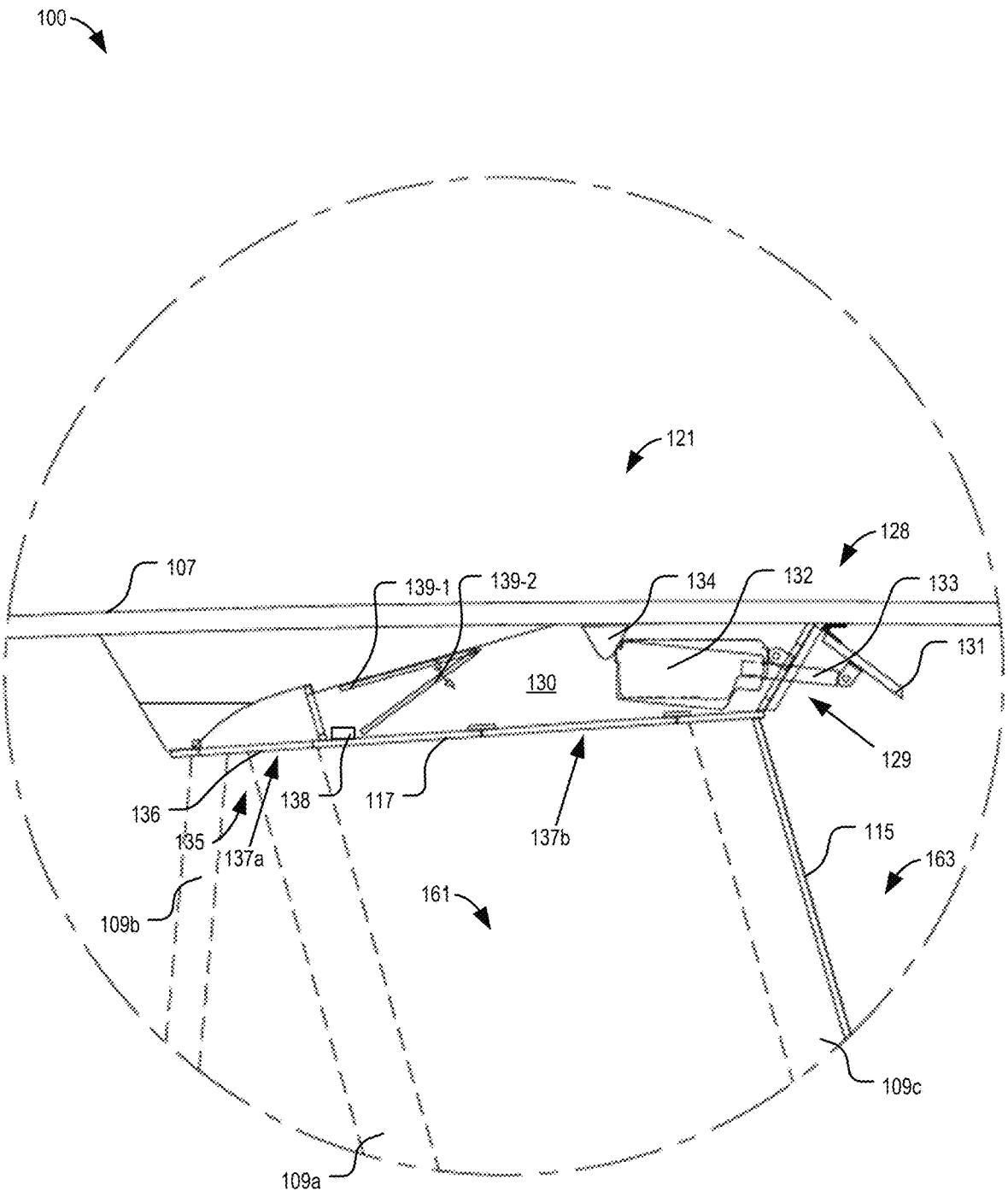
Figure 1C:
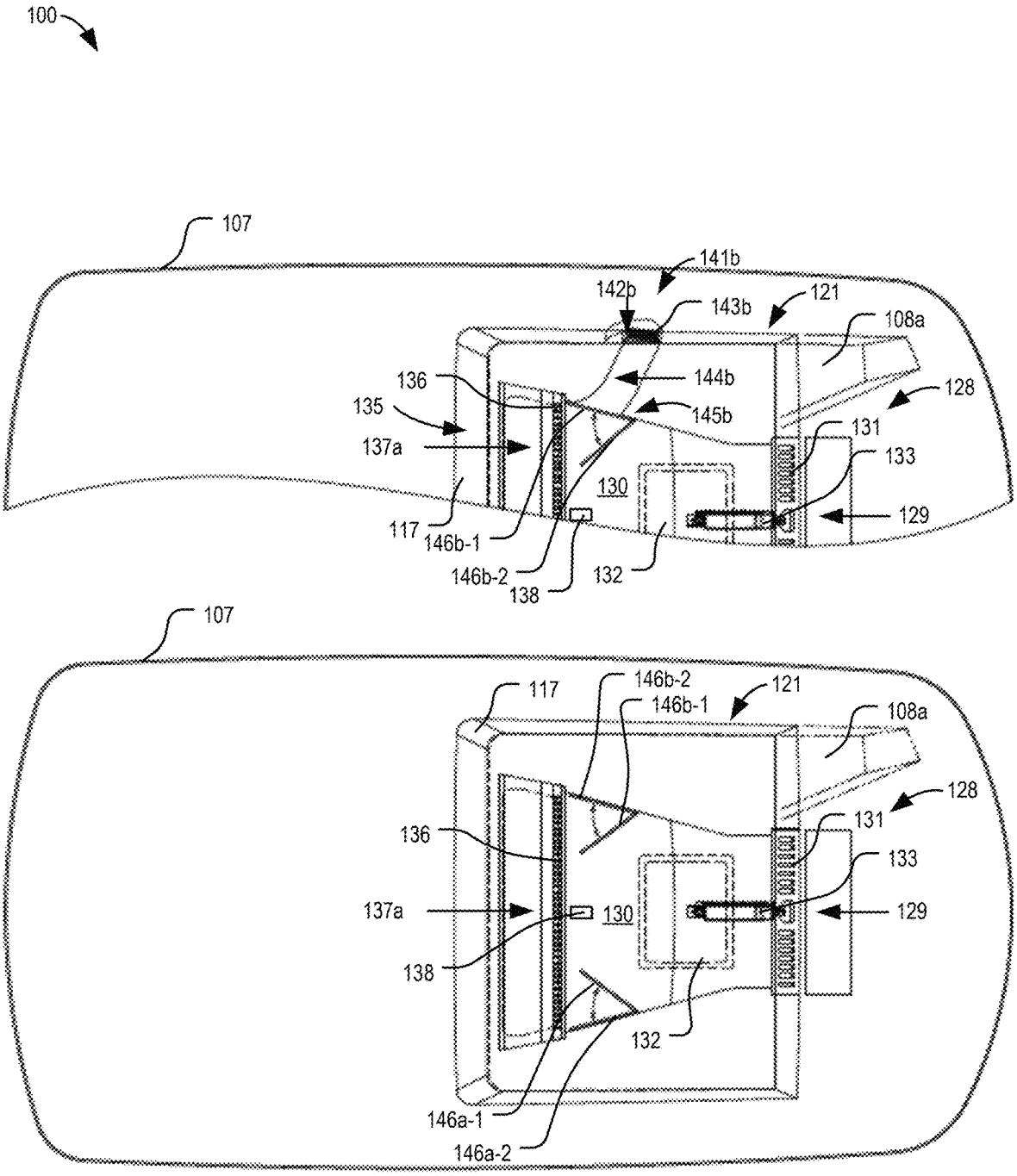
Figure 1D:
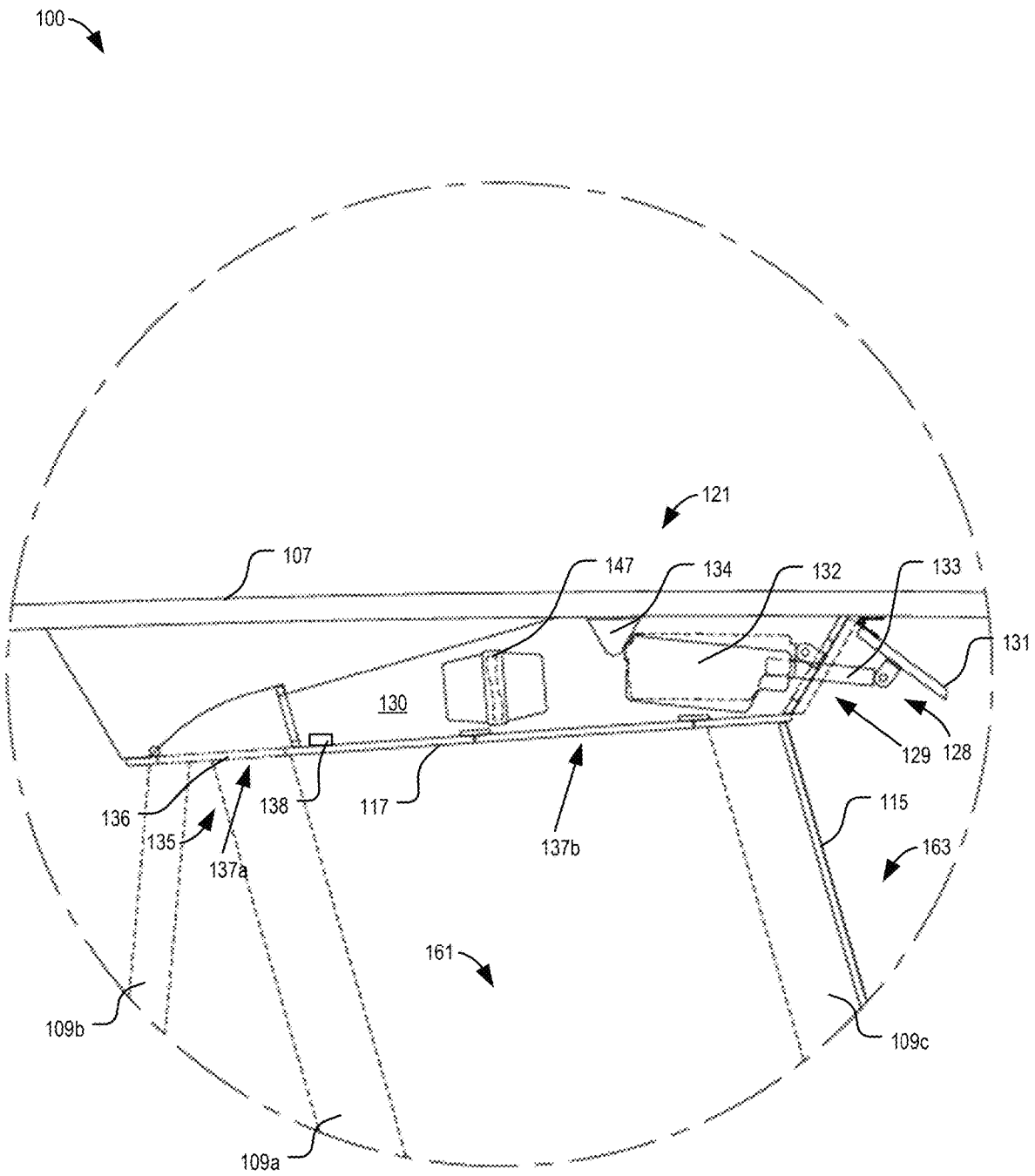

In another embodiment, a first internal vent structure 145*a,b* can be disposed in the cavity 130, 144*a,b* and can include a motor device mechanically coupled to a vent cover, vent damper or damper element 146*a,b*. The center of rotation of the vent cover 146*a,b* can be vertical, horizontal or another direction. As shown in FIG. 1C, the center of rotation of the vent cover 146*a,b* is vertical. The motor device can be operable to position the vent cover 146*a,b* in one of a set of vent cover positions relative to an aperture between the cavity 144*a,b* and the cavity 130 to control the airflow from the cavity 144*a,b* to the cavity 130. The controller device can be operationally coupled to the motor device and can be operable to control the motor device to position the vent cover 146*a,b* in one of the set of vent cover positions relative to the aperture between the cavity 144*a,b* and the cavity 130. As shown in FIG. 1C, the vent cover 146*a,b* is in a position associated with fully obstructed airflow entering the cavity 130 from the cavity 144*a,b*, as represented by reference 146*a*-1, 146*b*-1. Further, the vent cover 146*a,b* is shown in a position associated with unobstructed airflow entering the cavity 130 from the cavity 144*a,b*, as represented by reference 146*a*-2, 146*b*-2.

In another embodiment, a second internal vent structure 145*a,b* can be disposed in the cavity 130 and can include a motor device mechanically coupled to a vent cover 139. The motor device can be operable to position the vent cover 139 in one of a set of vent cover positions relative to an aperture of the cavity 130 to control the airflow through the cavity 130. The center of rotation of the vent cover 139 can be vertical, horizontal or another direction. As shown in FIG. 1B, the center of rotation of the vent cover 145*a,b* is horizontal. The controller device can be operationally coupled to the motor device and can be operable to control the motor device to position the vent cover 139 in one of the set of vent cover positions relative to the aperture of the cavity 130. As shown in FIG. 1B, the vent cover 139 is in a position associated with fully obstructed airflow through the cavity 130, as represented by reference 139-2. Further, the vent cover 139 is shown in a position associated with unobstructed airflow through the cavity 130, as represented by reference 139-1.

In another embodiment, the ventilation system 121 can also include a fan assembly 147. The controller can be operationally coupled to the fan assembly 147 to control a rotational speed of a fan of the fan assembly. In addition, an airflow sensor 138 can be disposed in the airflow cavity 130 and can be operable to measure a speed or volume of the airflow through the airflow cavity 130. The controller can receive, from the airflow sensor 138, an indication that includes the speed or volume measurement of the airflow through the airflow cavity 130. The controller can control the rotational speed of the fan of the fan assembly 147 to modify the speed or volume of the airflow through the airflow cavity 130 based on the measured speed or volume of the airflow through the airflow cavity 130.

In another embodiment, the housing structure 105 can include an airflow funneling structure 108*a* configured to funnel airflow towards the inlet aperture 129. As shown in FIG. 1A, the airflow funneling structure 108*a* is disposed on the port side of the marine vessel 100. However, the airflow funneling structure 108*a* can be symmetrically disposed about the inlet aperture 129 on both the port and starboard side of the marine vessel 100.

Figure 2A:
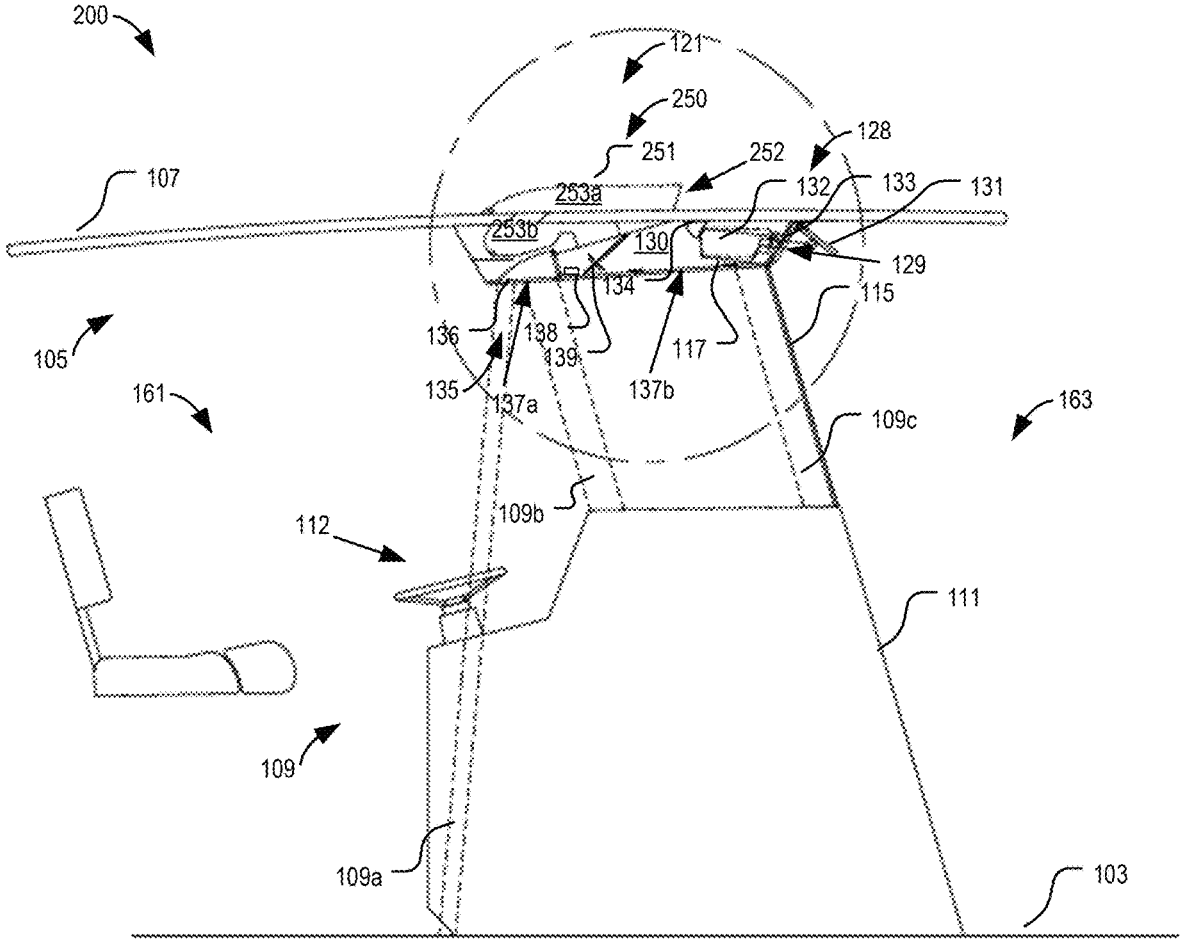
FIGS. 2A and 2B illustrate other embodiments of a marine vessel having a ventilation system in accordance with various aspects as described herein.
Figure 2C:
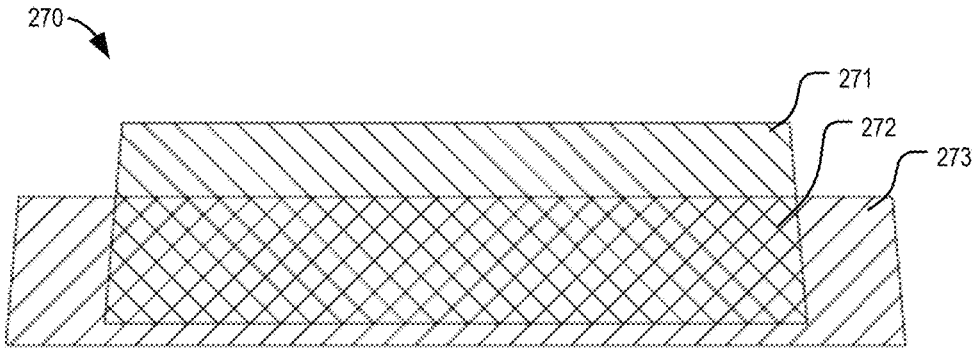
FIG. 2C illustrates a cross-section of a portion of the ventilation system of FIG. 2B.
Figure 2B:
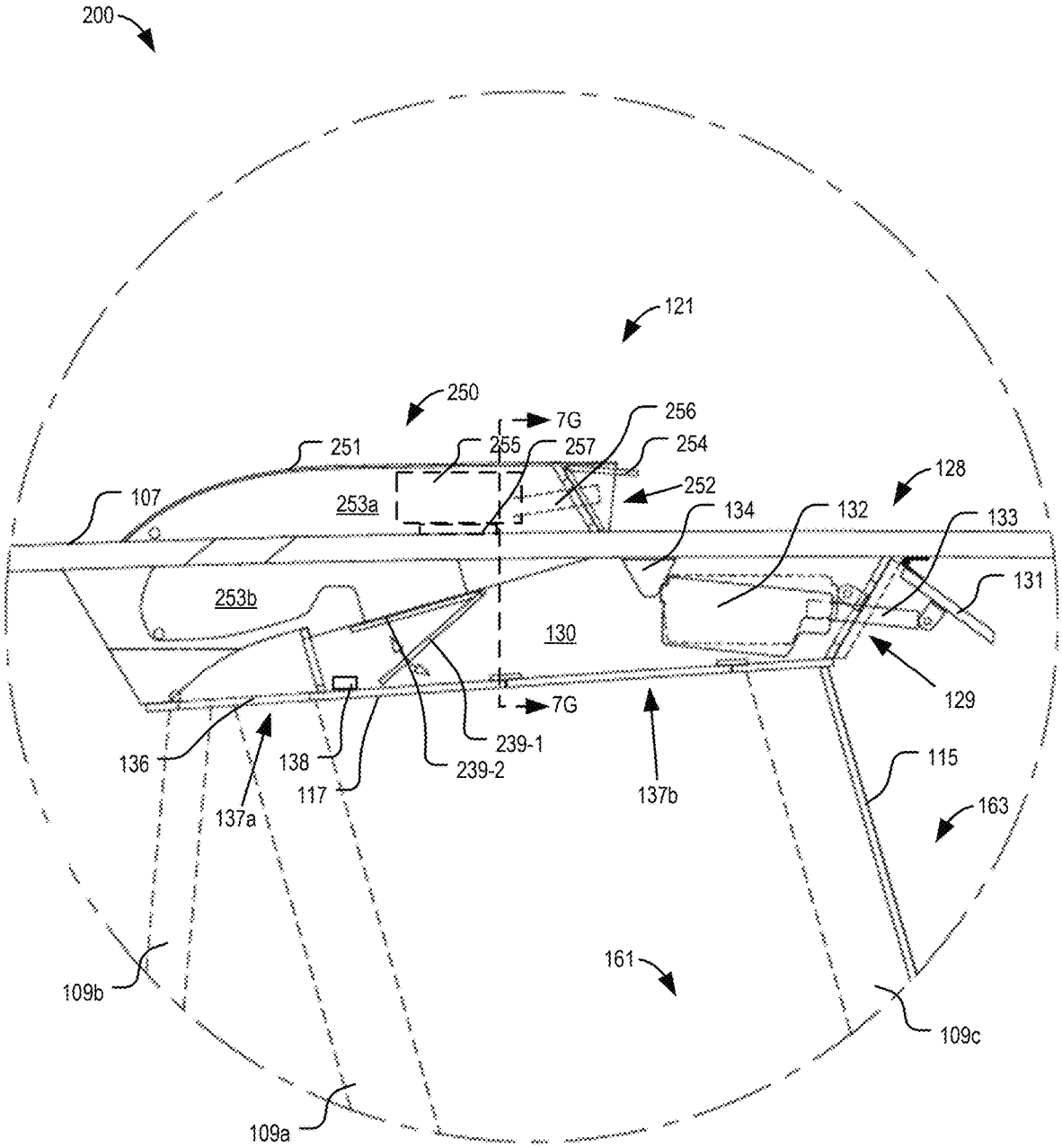

FIGS. 2A and 2B illustrate other embodiments of a marine vessel 200 having a ventilation system in accordance with various aspects as described herein. In FIGS. 2A-2B, the ventilation system 121 can include an inlet vent structure 250 having a housing 251, an inlet aperture 252 opened towards the bow of the marine vessel 200, a vent cover 254, a motor device 255 mechanically coupled to the vent cover 254, or the like. The inlet vent structure 250 can be configured to control airflow through the inlet aperture 252 towards the outlet apertures 137*a,b* such as through top airflow cavities 253*a,b* and the main airflow cavity 130. The motor device 255 can be operable to position the vent cover 254 in one of a set of vent cover positions relative to the inlet aperture 252 to control the airflow through the inlet aperture 252. The controller device can be operationally coupled to the motor device 255 and can be operable to control the motor device 255 to position the vent cover 254 in one of the set of vent cover positions relative to the inlet aperture 252. The motor device 255 can be securely coupled to the hardtop structure 107 via a support structure 257 in the cavity 253*a*.

FIG. 2C illustrates a cross-section 270 of a portion of the ventilation system 121 of FIGS. 2A and 2B that corresponds to the cavities 253*a,b,* 130 as indicated by cross-section reference 7G-7G in FIG. 2B. The cross-section 270 includes a first cross-section 271 associated with cavity 253*a,* a second cross-section 272 associated with cavity 253*b,* and a third cross-section 273 associated with cavity 130.

In another embodiment, a third internal vent structure 145*a,b* can be disposed in the cavity 130 and can include a motor device mechanically coupled to a vent cover 239. The motor device can be operable to position the vent cover 239 in one of a set of vent cover positions relative to an aperture between the cavity 253*b* and the cavity 130 to control the airflow through the cavity 253*b* into the cavity 130. The controller device can be operationally coupled to the motor device and can be operable to control the motor device to position the vent cover 239 in one of the set of vent cover positions relative to the aperture between the cavity 253*b* and the cavity 130. As shown in FIG. 2B, the vent cover 239 is in a position associated with fully obstructed airflow through the cavity 253*b* into the cavity 130, as represented by reference 239-2. Further, the vent cover 239 is shown in a position associated with unobstructed airflow through the cavity 253*b* into the cavity 130, as represented by reference 239-1.

Figure 3A:
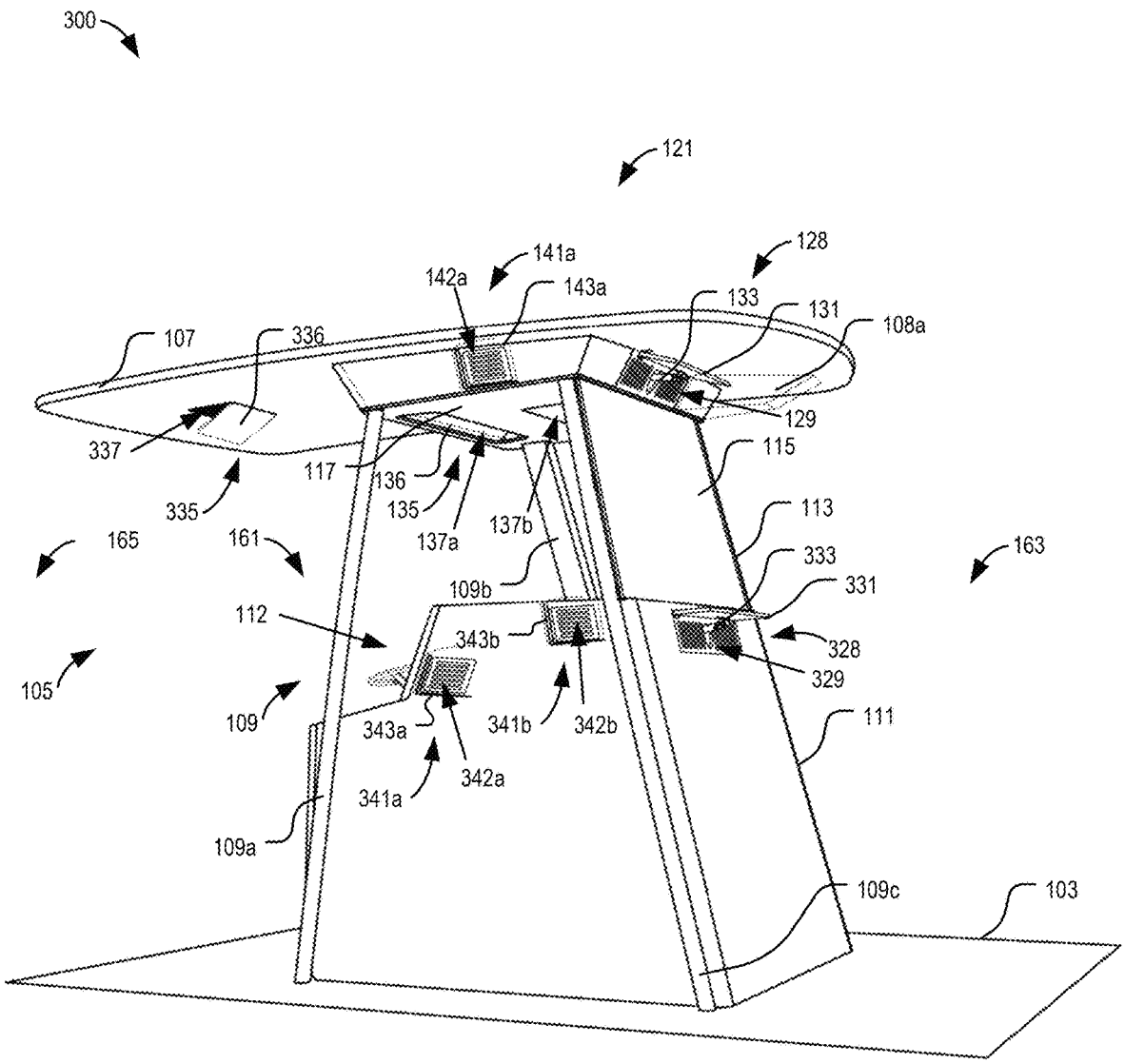
FIGS. 3A-3E illustrate other embodiments of a marine vessel having a ventilation system in accordance with various aspects as described herein.
Figure 3B:
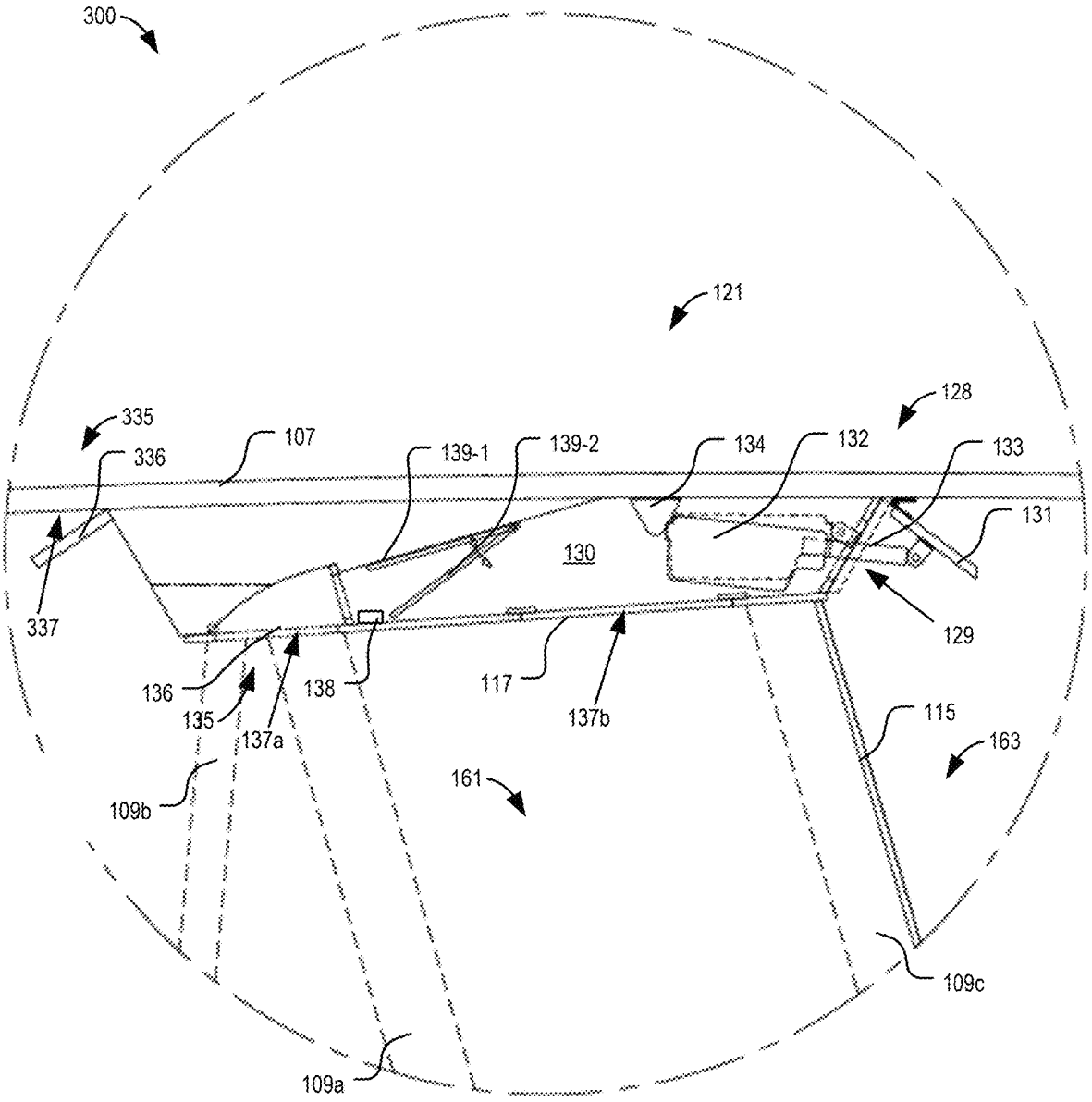
Figure 3C:
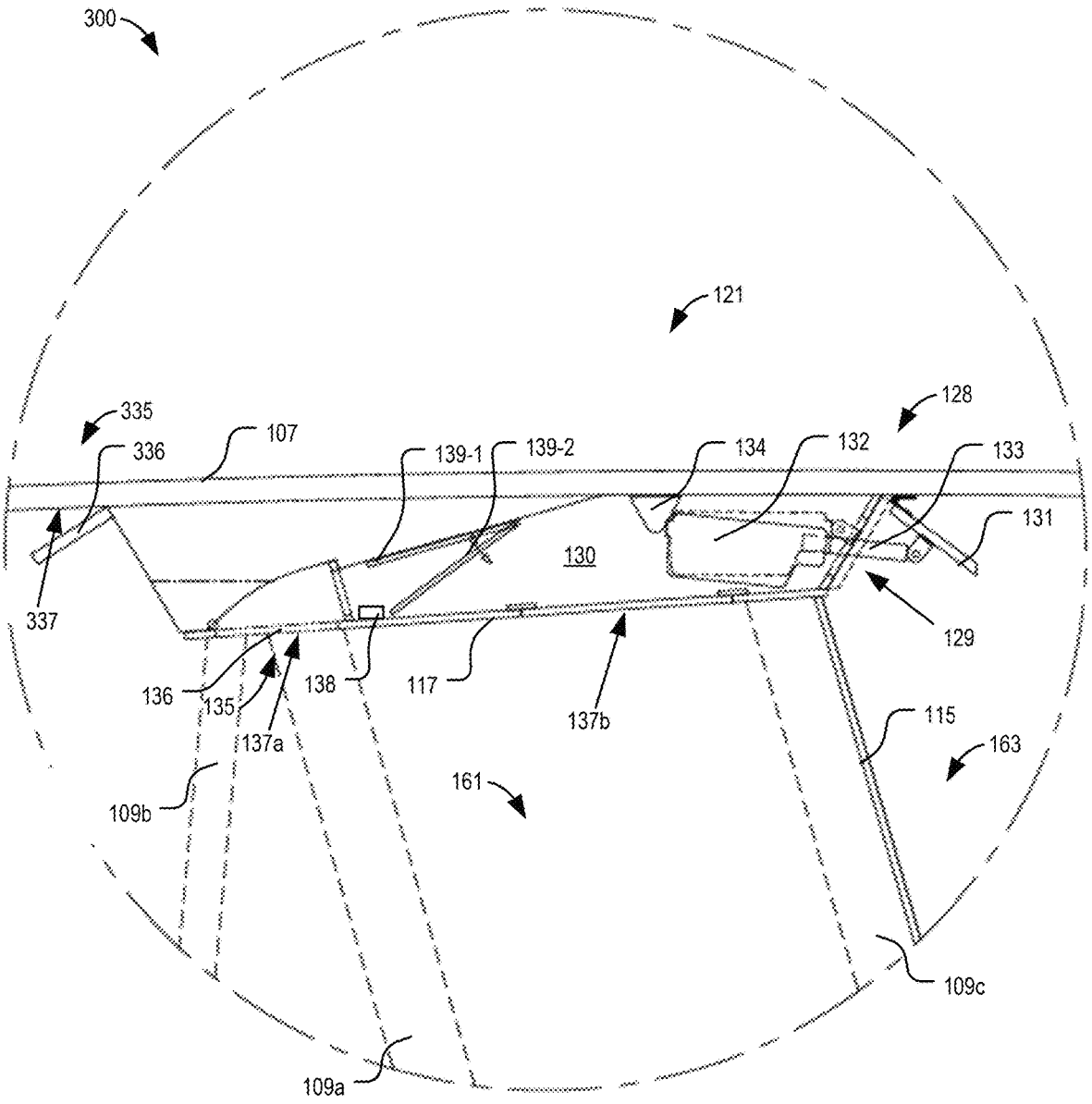
Figure 3D:
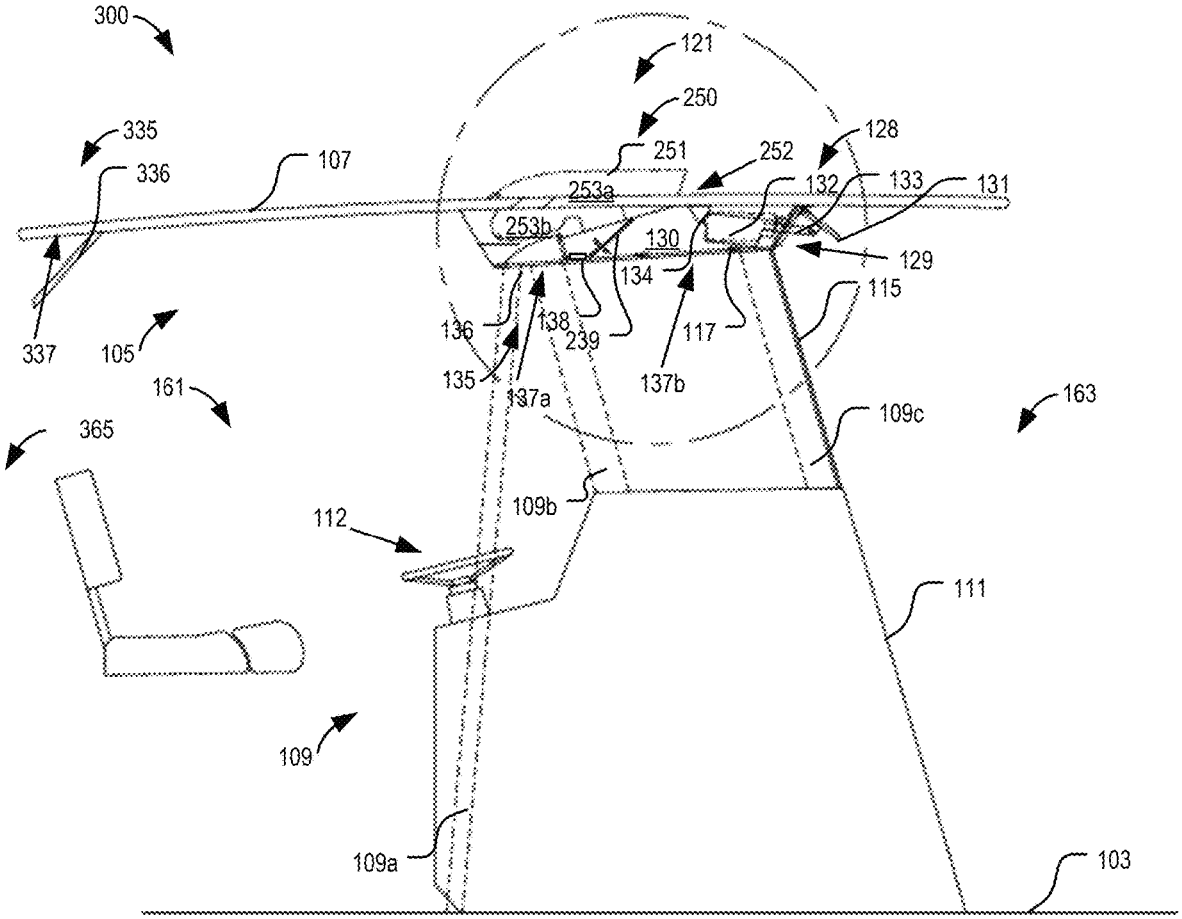

FIGS. 3A-3E illustrate other embodiments of a marine vessel 300 having a ventilation system 121 in accordance with various aspects as described herein. In FIG. 3A, the ventilation system 121 can include an inlet vent structure 341*a,b* having an inlet aperture 342*a,b* and a vent cover 343*a,b*. The inlet vent structure 341*a,b* can be configured to control airflow through the inlet aperture 342*a,b* to an outlet aperture associated with the console 112 via an airflow cavity associated with the console structure 111. Each inlet vent structure 341*a,b* can include the inlet aperture 342*a,b,* the vent cover 343*a,b,* and a motor device mechanically coupled to the vent cover 343*a,b*. The inlet vent structure 341*a,b* can be configured to control airflow through the inlet aperture 342*a,b* towards the outlet aperture associated with the console 112 via the airflow cavity associated with the console structure 111. The motor device can be operable to position the vent cover 343*a,b* in one of a set of vent cover positions relative to the inlet aperture 342*a,b* to control the airflow through the inlet aperture 342*a,b*. The controller device can be operationally coupled to the motor device and can be operable to control the motor device to position the vent cover 343*a,b* in one of the set of vent cover positions relative to the inlet aperture 342*a,b*.

In FIG. 3A, the ventilation system 121 can further include an inlet vent structure 328 having an inlet aperture 329 and a vent cover 331. The inlet vent structure 328 can be configured to control airflow through the inlet aperture 329 to an outlet aperture associated with the console 112 via an airflow cavity associated with the console structure 111. The inlet vent structure 328 can include the inlet aperture 329, the vent cover 331, and a motor device mechanically coupled to the vent cover 331 via a mechanical arm 333. The inlet vent structure 328 can be configured to control airflow through the inlet aperture 329 towards the outlet aperture associated with the console 112 via the airflow cavity associated with the console structure 111. The motor device can be operable to position the vent cover 331 in one of a set of vent cover positions relative to the inlet aperture 329 to control the airflow through the inlet aperture 329. The controller device can be operationally coupled to the motor device and can be operable to control the motor device to position the vent cover 331 in one of the set of vent cover positions relative to the inlet aperture 329.

In FIGS. 3A-3D, the ventilation system 121 can further include an outlet vent structure 335 associated with a stern area 365 of the marine vessel 300. The outlet vent structure 335 can include an outlet aperture 337, a vent cover 336, or a motor device operable to control the vent cover 336. The motor device can be securely coupled to the hardtop structure 107 via a support structure in a cavity of the hardtop structure 107. The motor device can be mechanically coupled to the vent cover 336 via a vent arm and can be operable to position the vent cover 336 in one of a set of vent cover positions relative to the outlet aperture 337. The controller device can be operationally coupled to the motor device and can be operable to control the motor device to position the vent cover 336 in one of the set of vent cover positions relative to the outlet aperture 337.

Figure 3E:
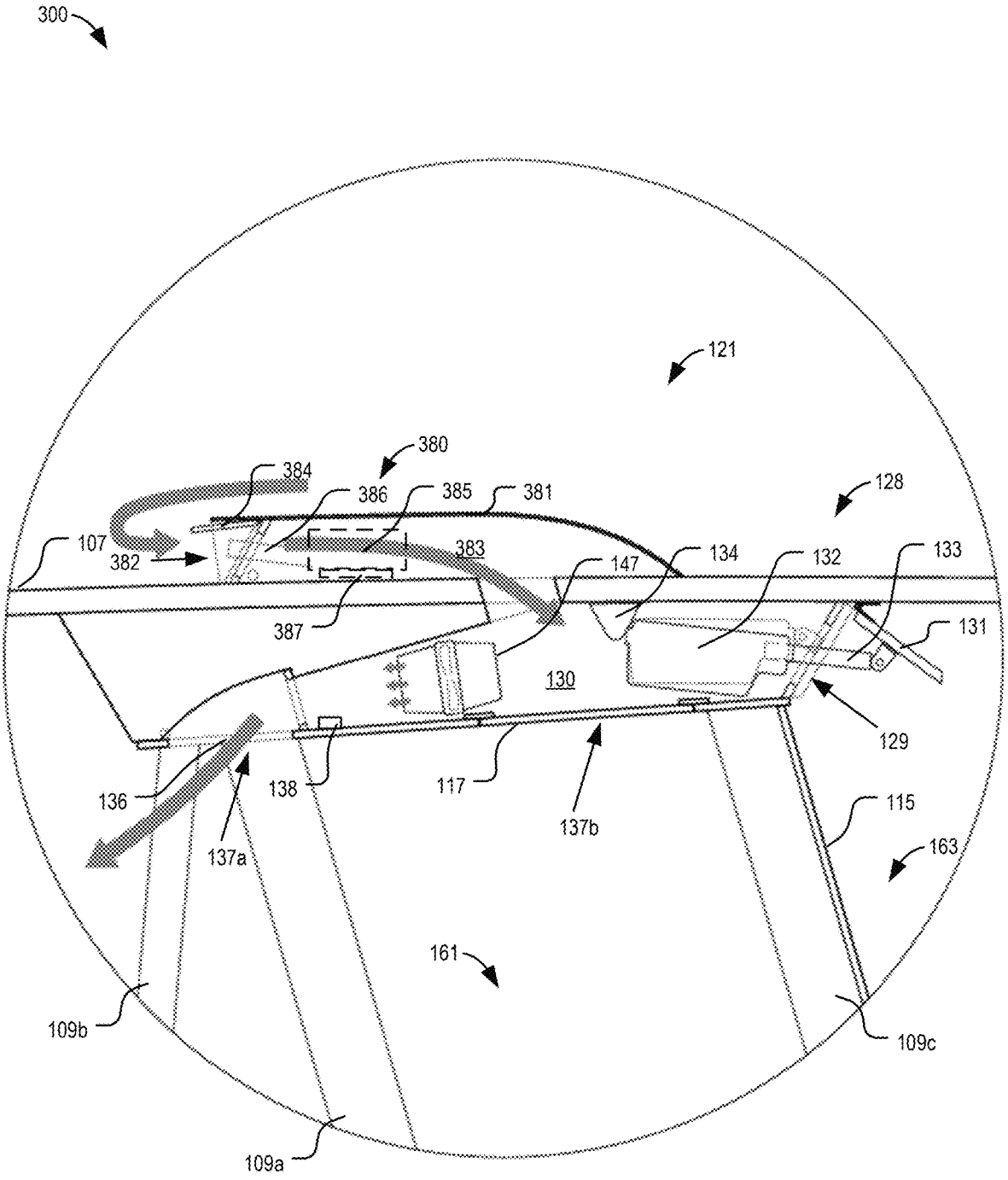

In FIG. 3E, the ventilation system 121 can include an inlet vent structure 380 having a housing 351, an inlet aperture 382 opened towards the stern of the marine vessel 200, a vent cover 384, a motor device 385 mechanically coupled to the vent cover 384, or the like. The inlet vent structure 380 can be configured to control airflow through the inlet aperture 382 towards the outlet apertures 137*a,b,* 337 such as through a top airflow cavity 283 and the main airflow cavity 130. The motor device 385 can be operable to position the vent cover 384 in one of a set of vent cover positions relative to the inlet aperture 382 to control the airflow through the inlet aperture 382. The controller device can be operationally coupled to the motor device 385 and can be operable to control the motor device 385 to position the vent cover 384 in one of the set of vent cover positions relative to the inlet aperture 382. The motor device 385 can be securely coupled to the hardtop structure 107 via a support structure 387 in the cavity 383.

Reserved.

FIG. 4 illustrates another embodiment of a marine vessel ventilation system controller device 400 in accordance with various aspects as described herein. In FIG. 4, device 400 includes processing circuitry 401 that is operatively coupled over bus 403 to input/output interface 405, artificial intelligence circuitry 409 (e.g., neural network circuit, machine learning circuit), network connection interface 411, power source 413, memory 415 including random access memory (RAM) 417, read-only memory (ROM) 419 and storage medium 421, communication subsystem 431, and/or any other component, or any combination thereof.

The input/output interface 405 may be configured to provide a communication interface to an input device, output device, or input and output device. The device 400 may be configured to use an output device via input/output interface 405. An output device may use the same type of interface port as an input device. For example, a USB port or a Bluetooth port may be used to provide input to and output from the device 400. The output device may be a speaker, a sound card, a video card, a display, a monitor, a printer, a motor device 461, a transducer (e.g., speaker, ultrasound emitter), an emitter, a smartcard, another output device, or any combination thereof. The device 400 may be configured to use an input device via input/output interface 405 to allow a user to capture information into the device 400. The input device may include a scanner device (e.g., optical scanner device), a touch-sensitive or presence-sensitive display, an optical sensor device (e.g., camera), a sensor, a microphone, a mouse, a trackball, a directional pad, a trackpad, a scroll wheel, a smartcard, and the like. The presence-sensitive display may include a capacitive or resistive touch sensor to sense input from a user. A sensor 463 may be, for instance, an accelerometer, a gyroscope, a tilt sensor, a force sensor, a magnetometer, an optical or image sensor, an infrared sensor, a proximity sensor, a microphone, an ultrasound sensor, a fluid pressure sensor, another like sensor, or any combination thereof.

In FIG. 4, storage medium 421 may include operating system 423, application program 425, data 427, the like, or any combination thereof. In other embodiments, storage medium 421 may include other similar types of information. Certain devices may utilize all of the components shown in FIG. 4, or only a subset of the components. The level of integration between the components may vary from one device to another device. Further, certain devices may contain multiple instances of a component, such as multiple processors, memories, neural networks, network connection interfaces, transceivers, etc.

In FIG. 4, processing circuitry 401 may be configured to process computer instructions and data. Processing circuitry 401 may be configured to implement any sequential state machine operative to execute machine instructions stored as machine-readable computer programs in the memory, such as one or more hardware-implemented state machines (e.g., in discrete logic, FPGA, ASIC, etc.); programmable logic together with appropriate firmware; one or more stored program, general-purpose processors, such as a microprocessor or Digital Signal Processor (DSP), together with appropriate software; or any combination of the above. For example, the processing circuitry 401 may include two central processing units (CPUs). Data may be information in a form suitable for use by a computer.

In FIG. 4, the artificial intelligence circuitry 409 may be configured to learn to perform tasks by considering examples such as contemporaneously controlling both the actuator device to re-position the vent inlet cover relative to the vent inlet aperture based on the velocity measurement and a rotational speed of the fan of the fan assembly based on the velocity measurement so as to adjust the velocity of air through the vent channel such as at a certain air velocity. In FIG. 4, the network connection interface 411 may be configured to provide a communication interface to network 443*a*. The network 443*a* may encompass wired and/or wireless networks such as a local-area network (LAN), a wide-area network (WAN), a computer network, a wireless network, a telecommunications network, another like network or any combination thereof. For example, network 443*a* may comprise a Wi-Fi network. The network connection interface 411 may be configured to include a receiver and a transmitter interface used to communicate with one or more other devices over a communication network according to one or more communication protocols, such as Ethernet, TCP/IP, SONET, ATM, or the like. The network connection interface 411 may implement receiver and transmitter functionality appropriate to the communication network links (e.g., optical, electrical, and the like). The transmitter and receiver functions may share circuit components, software or firmware, or alternatively may be implemented separately.

The RAM 417 may be configured to interface via a bus 403 to the processing circuitry 401 to provide storage or caching of data or computer instructions during the execution of software programs such as the operating system, application programs, and device drivers. The ROM 419 may be configured to provide computer instructions or data to processing circuitry 401. For example, the ROM 419 may be configured to store invariant low-level system code or data for basic system functions such as basic input and output (I/O), startup, or reception of keystrokes from a keyboard that are stored in a non-volatile memory. The storage medium 421 may be configured to include memory such as RAM, ROM, programmable read-only memory (PROM), erasable programmable read-only memory (EPROM), electrically erasable programmable read-only memory (EEPROM), magnetic disks, optical disks, floppy disks, hard disks, removable cartridges, or flash drives. In one example, the storage medium 421 may be configured to include an operating system 423, an application program 425 such as web browser, web application, user interface, browser data manager as described herein, a widget or gadget engine, or another application, and a data file 427. The storage medium 421 may store, for use by the device 400, any of a variety of various operating systems or combinations of operating systems.

The storage medium 421 may be configured to include a number of physical drive units, such as redundant array of independent disks (RAID), floppy disk drive, flash memory, USB flash drive, external hard disk drive, thumb drive, pen drive, key drive, high-density digital versatile disc (HD-DVD) optical disc drive, internal hard disk drive, Blu-Ray optical disc drive, holographic digital data storage (HDDS) optical disc drive, external mini-dual in-line memory module (DIMM), synchronous dynamic random access memory (SDRAM), external micro-DIMM SDRAM, smartcard memory such as a subscriber identity module or a removable user identity (SIM/RUIM) module, other memory, or any combination thereof. The storage medium 421 may allow the device 400 to access computer-executable instructions, application programs or the like, stored on transitory or non-transitory memory media, to off-load data, or to upload data. An article of manufacture, such as one utilizing a communication system may be tangibly embodied in the storage medium 421, which may comprise a device readable medium.

The processing circuitry 401 may be configured to communicate with network 443*b* using the communication subsystem 431. The network 443*a* and the network 443*b* may be the same network or networks or different network or networks. The communication subsystem 431 may be configured to include one or more transceivers used to communicate with the network 443*b*. For example, the communication subsystem 431 may be configured to include one or more transceivers used to communicate with one or more remote transceivers of another device capable of wireless communication according to one or more communication protocols, such as IEEE 802.11, CDMA, WCDMA, GSM, LTE, UTRAN, WiMax, or the like. Each transceiver may include transmitter 433 and/or receiver 435 to implement transmitter or receiver functionality, respectively, appropriate to the RAN links (e.g., frequency allocations and the like). Further, transmitter 433 and receiver 435 of each transceiver may share circuit components, software, or firmware, or alternatively may be implemented separately.

In FIG. 4, the communication functions of the communication subsystem 431 may include data communication, voice communication, multimedia communication, short-range communications such as Bluetooth, near-field communication, location-based communication such as the use of the global positioning system (GPS) to determine a location, another like communication function, or any combination thereof. For example, the communication subsystem 431 may include cellular communication, Wi-Fi communication, Bluetooth communication, and GPS communication. The network 443*b* may encompass wired and/or wireless networks such as a local-area network (LAN), a wide-area network (WAN), a computer network, a wireless network, a telecommunications network, another like network or any combination thereof. For example, the network 443*b* may be a cellular network, a Wi-Fi network, and/or a near-field network. The power source 413 may be configured to provide alternating current (AC) or direct current (DC) power to components of the device 400.

The features, benefits and/or functions described herein may be implemented in one of the components of the device 400 or partitioned across multiple components of the device 400. Further, the features, benefits, and/or functions described herein may be implemented in any combination of hardware, software, or firmware. In one example, communication subsystem 431 may be configured to include any of the components described herein. Further, the processing circuitry 401 may be configured to communicate with any of such components over the bus 403. In another example, any of such components may be represented by program instructions stored in memory that when executed by the processing circuitry 401 perform the corresponding functions described herein. In another example, the functionality of any of such components may be partitioned between the processing circuitry 401 and the communication subsystem 431. In another example, the non-computationally intensive functions of any of such components may be implemented in software or firmware and the computationally intensive functions may be implemented in hardware.

Those skilled in the art will also appreciate that embodiments herein further include corresponding computer programs.

A computer program comprises instructions which, when executed on at least one processor of an apparatus, cause the apparatus to carry out any of the respective processing described above. A computer program in this regard may comprise one or more code modules corresponding to the means or units described above.

Embodiments further include a carrier containing such a computer program. This carrier may comprise one of an electronic signal, optical signal, radio signal, or computer readable storage medium.

In this regard, embodiments herein also include a computer program product stored on a non-transitory computer readable (storage or recording) medium and comprising instructions that, when executed by a processor of an apparatus, cause the apparatus to perform as described above.

Embodiments further include a computer program product comprising program code portions for performing the steps of any of the embodiments herein when the computer program product is executed by a computing device. This computer program product may be stored on a computer readable recording medium.

Additional embodiments will now be described. At least some of these embodiments may be described as applicable in certain contexts for illustrative purposes, but the embodiments are similarly applicable in other contexts not explicitly described.

In one exemplary embodiment, a marine vessel includes a housing structure having a helm and a ventilation system disposed in the housing structure, including a vent inlet aperture, a vent channel, a vent outlet aperture and a vent inlet cover configured to be: fully disposed about the vent inlet aperture while in a closed position so that no air flow can enter the vent inlet aperture, partially disposed about the vent inlet aperture while in a partially opened position so that partially obstructed air flow can enter the vent inlet aperture, or in a fully opened position so that unobstructed air flow can enter the vent inlet aperture.

In another exemplary embodiment, the ventilation system can further include a fan assembly disposed in the vent channel and operable to move air flow from the vent inlet aperture towards the vent outlet aperture.

In another exemplary embodiment, the ventilation system can further include an actuator device mechanically coupled to the vent inlet cover and operable to position the vent inlet cover in the closed position, the partially opened position, and the fully opened position; or a controller device operationally coupled to the actuator and operable to control the actuator device to position the vent inlet cover.

In another exemplary embodiment, the ventilation system can further include an air flow sensor disposed in the vent channel and operable to measure a velocity of air through the vent channel. Further, the controller device can be further operable to receive, from the air flow sensor, an indication that includes a measurement of the velocity of air through the vent channel. In addition, the controller device can be further operable to control the actuator device to re-position the vent inlet cover relative to the vent inlet aperture based on the velocity measurement so as to adjust the velocity of air through the vent channel.

In another exemplary embodiment, the ventilation system can further include a fan assembly disposed in the vent channel and operable to move air flow from the vent inlet aperture towards the vent outlet aperture. Further, the controller device can be operationally coupled to the fan assembly and can be further operable to control a rotational speed of a fan of the fan assembly based on the velocity measurement so as to adjust the velocity of air through the vent channel.

In another exemplary embodiment, the controller device can be further operable to contemporaneously control both the actuator device to re-position the vent inlet cover relative to the vent inlet aperture based on the velocity measurement and a rotational speed of the fan of the fan assembly based on the velocity measurement so as to adjust the velocity of air through the vent channel such as at a certain air velocity.

In another exemplary embodiment, the vent inlet aperture can be positioned on the housing structure associated with the bow area.

In another exemplary embodiment, the vent inlet aperture can be positioned on a port side, a starboard side or both of the housing structure.

In another exemplary embodiment, the vent inlet aperture can be positioned on a hardtop structure (e.g., roof, topside) of the housing structure.

In another exemplary embodiment, the outlet vent aperture can be configured to direct airflow in or towards a helm area of the housing structure.

In another exemplary embodiment, a surface area of the outlet vent aperture can be different from a surface area of the inlet vent aperture.

In one exemplary embodiment, a marine vessel includes a housing structure associated with bow and helm areas of the marine vessel. Further, the housing structure includes a ventilation system that includes an airflow channel disposed in the housing structure with inlet and outlet apertures associated with the respective bow and helm areas. The airflow channel is configured to enable airflow from the inlet aperture to the outlet aperture. Further, the ventilation system further includes an inlet or outlet vent structure configured to selectively control the airflow entering or exiting the inlet or outlet aperture.

In one exemplary embodiment, a method is performed by a marine vessel having a hardtop structure that is disposed about a helm area that includes a support structure coupled to both a center console structure and a windshield structure. Further, the windshield structure disposed between the helm area and a bow area and a portion of the hardtop structure disposed in the bow area, the hardtop structure having a ventilation system that includes an airflow cavity disposed in the hardtop structure with inlet and outlet apertures associated with the respective bow and helm areas, the airflow cavity being configured to enable airflow from the inlet aperture to the outlet aperture, with the ventilation system further including an inlet or outlet vent structure. The method includes controlling, by a controller device operationally coupled to the inlet or outlet vent structure, the airflow entering or exiting the inlet or outlet aperture.

In another exemplary embodiment, the ventilation system can further include a fan assembly disposed in the airflow cavity and operable to move the air flow from the inlet aperture towards the outlet aperture through the airflow cavity.

In another exemplary embodiment, the method can further include controlling, by the controller device operationally coupled to the fan assembly, a rotational speed of a fan of the fan assembly.

In another exemplary embodiment, the method can include receiving, by the controller device, from an airflow sensor disposed in the airflow cavity, an indication that includes a measurement of a speed or volume of the airflow through the airflow cavity and controlling, by the controller device, a rotational speed of a fan of the fan assembly to modify a speed or volume of the airflow from the inlet aperture towards the outlet aperture through the airflow cavity based on the measured speed or volume of the airflow through the airflow cavity.

In another exemplary embodiment, the inlet or outlet vent structure can further includes a motor device mechanically coupled to a vent cover and operable to position the vent cover in one of a set of vent cover positions relative to the inlet or outlet aperture.

In another exemplary embodiment, the method can further include controlling, by the controller device operationally coupled to the motor device, the motor device to position the vent cover in the one of the set of vent cover positions relative to the inlet or outlet aperture.

In another exemplary embodiment, the method can further include receiving, by the controller device, from an airflow sensor disposed in the airflow cavity and operable to measure a speed or volume of airflow through the airflow cavity, an indication that includes a measurement of the speed or volume of the airflow through the airflow cavity and controlling, by the controller device, the motor device to position the vent cover in the one of the set of vent cover positions relative to the inlet or outlet aperture based on the measured speed or volume of the airflow through the airflow cavity.

In another exemplary embodiment, the set of vent cover positions relative to the inlet or outlet aperture can include a first vent cover position associated with fully obstructed airflow entering or exiting that aperture, a second vent cover position associated with partially obstructed airflow entering or exiting that aperture, and a third vent cover position associated with unobstructed airflow entering or exiting that aperture.

In another exemplary embodiment, the method can further include controlling, by the controller device operationally coupled to a first motor device of the inlet vent structure that is mechanically coupled to the inlet vent cover, the first motor device to position the inlet vent cover in one of a set of vent cover positions relative to the inlet aperture and controlling, by the controller device operationally coupled to a second motor device of the outlet vent structure that is mechanically coupled to the outlet vent cover, the second motor device to position the outlet vent cover in one of a set of vent cover positions relative to the outlet aperture.

In another exemplary embodiment, the method can further include independently controlling, by the controller device, each motor device to position the corresponding vent cover in the one of the set of vent cover positions.

In one exemplary embodiment, a marine vessel includes a hardtop structure disposed about a helm area that includes a support structure coupled to both a center console structure and a windshield structure. Further, the windshield structure is disposed between the helm area and a bow area and a portion of the hardtop structure is disposed in the bow area. The hardtop structure includes a ventilation system having an airflow cavity disposed in the hardtop structure with inlet and outlet apertures associated with the respective bow and helm areas. The airflow cavity is configured to enable airflow from the inlet aperture to the outlet aperture. In addition, the ventilation system further includes an inlet or outlet vent structure configured to control the airflow entering or exiting the inlet or outlet aperture.

The previous detailed description is merely illustrative in nature and is not intended to limit the present disclosure, or the application and uses of the present disclosure. Furthermore, there is no intention to be bound by any expressed or implied theory presented in the preceding field of use, background, summary, or detailed description. The present disclosure provides various examples, embodiments and the like, which may be described herein in terms of functional or logical block elements. The various aspects described herein are presented as methods, devices (or apparatus), systems, or articles of manufacture that may include a number of components, elements, members, modules, nodes, peripherals, or the like. Further, these methods, devices, systems, or articles of manufacture may include or not include additional components, elements, members, modules, nodes, peripherals, or the like.

Furthermore, the various aspects described herein may be implemented using standard programming or engineering techniques to produce software, firmware, hardware (e.g., circuits), or any combination thereof to control a computing device to implement the disclosed subject matter. It will be appreciated that some embodiments may be comprised of one or more generic or specialized processors such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the methods, devices and systems described herein. Alternatively, some or all functions could be implemented by a state machine that has no stored program instructions, or in one or more application specific integrated circuits (ASICs), in which each function or some combinations of certain of the functions are implemented as custom logic circuits. Of course, a combination of the two approaches may be used. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The term "article of manufacture" as used herein is intended to encompass a computer program accessible from any computing device, carrier, or media. For example, a computer-readable medium may include: a magnetic storage device such as a hard disk, a floppy disk or a magnetic strip; an optical disk such as a compact disk (CD) or digital versatile disk (DVD); a smart card; and a flash memory device such as a card, stick or key drive. Additionally, it should be appreciated that a carrier wave may be employed to carry computer-readable electronic data including those used in transmitting and receiving electronic data such as electronic mail (e-mail) or in accessing a computer network such as the Internet or a local area network (LAN). Of course, a person of ordinary skill in the art will recognize many modifications may be made to this configuration without departing from the scope or spirit of the subject matter of this disclosure.

Throughout the specification and the embodiments, the following terms take at least the meanings explicitly associated herein, unless the context clearly dictates otherwise. Relational terms such as "first" and "second," and the like may be used solely to distinguish one entity or action from another entity or action without necessarily requiring or implying any actual such relationship or order between such entities or actions. The term "or" is intended to mean an inclusive "or" unless specified otherwise or clear from the context to be directed to an exclusive form. Further, the terms "a," "an," and "the" are intended to mean one or more unless specified otherwise or clear from the context to be directed to a singular form. The term "include" and its various forms are intended to mean including but not limited to. References to "one embodiment," "an embodiment," "example embodiment," "various embodiments," and other like terms indicate that the embodiments of the disclosed technology so described may include a particular function, feature, structure, or characteristic, but not every embodiment necessarily includes the particular function, feature, structure, or characteristic. Further, repeated use of the phrase "in one embodiment" does not necessarily refer to the same embodiment, although it may. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A device or structure that is "configured" in a certain way is configured in at least that way, but may also be configured in ways that are not listed.

What is claimed is:

1. A method, comprising:

by a marine vessel having a hardtop structure disposed about a helm area that includes a support structure coupled to both a console structure and a seamless windshield structure, wherein the seamless windshield structure is disposed between the helm area and a bow area and the hardtop structure extends from the helm area to the bow area, the hardtop structure having a ventilation system that includes an airflow cavity disposed in the hardtop structure with an inlet aperture configured to receive airflow from the bow area and an outlet aperture configured to direct airflow into the helm area, the airflow cavity being configured to enable airflow from the inlet aperture to the outlet aperture, the ventilation system further including an inlet or outlet vent structure, controlling, by a controller device operationally coupled to the inlet or outlet vent structure, the airflow entering or exiting the inlet or outlet aperture.

2. The method of claim 1, wherein the ventilation system further includes:

a fan assembly disposed in the airflow cavity and operable to move the airflow from the inlet aperture towards the outlet aperture through the airflow cavity.

3. The method of claim 2, further comprising:

controlling, by the controller device operationally coupled to the fan assembly, a rotational speed of a fan of the fan assembly.

4. The method of claim 3, further comprising:

receiving, by the controller device, from an airflow sensor disposed in the airflow cavity, an indication that includes a measurement of a speed or volume of the airflow through the airflow cavity; and controlling, by the controller device, a rotational speed of a fan of the fan assembly to modify a speed or volume of the airflow from the inlet aperture towards the outlet aperture through the airflow cavity based on the measured speed or volume of the airflow through the airflow cavity.

5. The method of claim 1, wherein the inlet or outlet vent structure further includes:

a motor device mechanically coupled to a vent cover and operable to position the vent cover in one of a set of vent cover positions relative to the inlet or outlet aperture.

6. The method of claim 5, further comprising:

controlling, by the controller device operationally coupled to the motor device, the motor device to position the vent cover in the one of the set of vent cover positions relative to the inlet or outlet aperture.

7. The method of claim 6, further comprising:

receiving, by the controller device, from an airflow sensor disposed in the airflow cavity and operable to measure a speed or volume of airflow through the airflow cavity, an indication that includes a measurement of the speed or volume of the airflow through the airflow cavity; and controlling, by the controller device, the motor device to position the vent cover in the one of the set of vent cover positions relative to the inlet or outlet aperture based on the measured speed or volume of the airflow through the airflow cavity.

8. The method of claim 5, wherein the set of vent cover positions relative to the inlet or outlet aperture includes a first vent cover position associated with fully obstructed airflow entering or exiting that aperture, a second vent cover position associated with partially obstructed airflow entering or exiting that aperture, and a third vent cover position associated with unobstructed airflow entering or exiting that aperture.

9. The method of claim 1, further comprising:

controlling, by the controller device operationally coupled to a first motor device of the inlet vent structure that is mechanically coupled to the inlet vent cover, the first motor device to position the inlet vent cover in one of a set of vent cover positions relative to the inlet aperture; and controlling, by the controller device operationally coupled to a second motor device of the outlet vent structure that is mechanically coupled to the outlet vent cover, the second motor device to position the outlet vent cover in one of a set of vent cover positions relative to the outlet aperture.

10. The method of claim 9, further comprising:

independently controlling, by the controller device, each motor device to position the corresponding vent cover in the one of the set of vent cover positions.

11. A marine vessel, comprising:

a hardtop structure that is disposed about a helm area that includes a support structure coupled to both a console structure and a seamless windshield structure, wherein the seamless windshield structure is disposed between the helm area and a bow area and the hardtop structure extends from the helm area to the bow area, the hardtop structure having a ventilation system that includes an airflow cavity disposed in the hardtop structure with an inlet aperture configured to receive airflow from the bow area and an outlet aperture configured to direct airflow into the helm area, the airflow cavity being configured to enable airflow from the inlet aperture to the outlet aperture, with the ventilation system further including an inlet or outlet vent structure configured to control the airflow entering or exiting the inlet or outlet aperture.

12. The marine vessel of claim 11, wherein the ventilation system further includes:

a fan assembly disposed in the airflow cavity and operable to move the airflow from the inlet aperture towards the outlet aperture through the airflow cavity.

13. The marine vessel of claim 12, wherein the ventilation system further includes:

a controller device operationally coupled to the fan assembly and operable to control a rotational speed of a fan of the fan assembly.

14. The marine vessel of claim 13, wherein the ventilation system further includes:

an airflow sensor disposed in the airflow cavity and operable to measure a speed or volume of air through the airflow cavity; and wherein the controller device is further operable to:

receive, from the airflow sensor, an indication that includes a measurement of the speed or volume of the airflow through the airflow cavity; and control the fan assembly to modify a speed of the airflow from the inlet aperture towards the outlet aperture through the airflow cavity based on the measured speed or volume of the airflow through the airflow cavity.

15. The marine vessel of claim 11, wherein the inlet or outlet vent structure further includes:

a motor device mechanically coupled to a vent cover and operable to position the vent cover in one of a set of vent cover positions relative to the inlet or outlet aperture.

16. The marine vessel of claim 15, wherein the ventilation system further includes:

a controller device operationally coupled to the motor device and operable to control the motor device to position the vent cover in the one of the set of vent cover positions relative to the inlet or outlet aperture.

17. The marine vessel of claim 16, wherein the ventilation system further includes:

an airflow sensor disposed in the airflow cavity and operable to measure a speed or volume of air through the airflow cavity; and wherein the controller device is further operable to:

receive, from the airflow sensor, an indication that includes a measurement of the speed or volume of the airflow through the airflow cavity; and control the motor device to position the vent cover in the one of the set of vent cover positions relative to the inlet or outlet aperture based on the measured speed or volume of the airflow through the airflow cavity.

18. The marine vessel of claim 15, wherein the set of vent cover positions relative to the inlet or outlet aperture includes a first vent cover position associated with fully obstructed airflow entering or exiting that aperture, a second vent cover position associated with partially obstructed airflow entering or exiting that aperture, and a third vent cover position associated with unobstructed airflow entering or exiting that aperture.

19. The marine vessel of claim 11, wherein the inlet vent structure further includes:

a first motor device mechanically coupled to an inlet vent cover and operable to position the inlet vent cover in one of a set of vent cover positions relative to the inlet aperture; and wherein the outlet vent structure further includes:

a second motor device mechanically coupled to an outlet vent cover and operable to position the outlet vent cover in one of the set of vent cover positions relative to the outlet aperture.

20. The marine vessel of claim 19, wherein the ventilation system further includes:

a controller device operationally coupled to the first and second motor devices and operable to independently control each motor device to position the corresponding vent cover in the one of the set of vent cover positions.

* * * * *